US010020097B2

(12) United States Patent
Nakajima et al.

(10) Patent No.: US 10,020,097 B2
(45) Date of Patent: Jul. 10, 2018

(54) R-T-B RARE EARTH SINTERED MAGNET AND METHOD OF MANUFACTURING THE SAME

(71) Applicant: SHOWA DENKO K.K., Minato-ku, Tokyo (JP)

(72) Inventors: Kenichiro Nakajima, Chichibu (JP); Akifumi Muraoka, Chichibu (JP); Takashi Yamazaki, Chichibu (JP)

(73) Assignee: SHOWA DENKO K.K., Tokyo (JP)

( * ) Notice: Subject to any disclaimer, the term of this patent is extended or adjusted under 35 U.S.C. 154(b) by 516 days.

(21) Appl. No.: 14/257,512

(22) Filed: Apr. 21, 2014

(65) Prior Publication Data

US 2014/0314612 A1 Oct. 23, 2014

(30) Foreign Application Priority Data

Apr. 22, 2013 (JP) ..... 2013-089744
Jul. 19, 2013 (JP) ..... 2013-151073

(51) Int. Cl.
*H01F 1/053* (2006.01)
*H01F 41/02* (2006.01)
(Continued)

(52) U.S. Cl.
CPC ..... *H01F 1/0536* (2013.01); *C22C 38/001* (2013.01); *C22C 38/002* (2013.01);
(Continued)

(58) Field of Classification Search
None
See application file for complete search history.

(56) References Cited

U.S. PATENT DOCUMENTS

2002/0020470 A1* 2/2002 Okumura ..... C22C 1/0441 148/108
2006/0051233 A1* 3/2006 Ugai ..... B22F 5/003 419/6

(Continued)

FOREIGN PATENT DOCUMENTS

CN 101521068 A 9/2009
CN 102067249 A 5/2011

(Continued)

OTHER PUBLICATIONS

Machine translation of JP2006-249547 A, Sep. 2006.*

(Continued)

*Primary Examiner* — Xiaowei Su
(74) *Attorney, Agent, or Firm* — Sughrue Mion, PLLC

(57) ABSTRACT

A method of manufacturing an R-T-B rare earth sintered magnet includes a process of disposing and sintering a compact of a first alloy powder and an alloy material of a second alloy in a chamber of a sintering furnace. The first alloy consists of R which represents a rare earth element, T which represents a transition metal essentially containing Fe, a metal element M which represents Al and/or Ga, B, Cu, and inevitable impurities. The first alloy contains 11 at % to 17 at % of R, 4.5 at % to 6 at % of B, 0 at % to 1.6 at % of M, and T as the balance, and Dy content in all of the rare earth elements is 0 at % to 29 at %. The second alloy consists of R which represents a rare earth element, T which represents a transition metal essentially containing Fe, a metal element M which represents Al and/or Ga, B, Cu, and inevitable impurities. The second alloy contains 11 at % to 20 at % of R, 4.5 at % to 6 at % of B, and 0 at % to 1.6 at % of M, and T as the balance, and Dy content in all of the rare earth elements is 0 at % to 29 at %.

11 Claims, 4 Drawing Sheets

(51) Int. Cl.

| | |
|---|---|
| ***B22F 3/12*** | (2006.01) |
| ***H01F 1/057*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| ***C22C 38/42*** | (2006.01) |

(52) U.S. Cl.
CPC ..... *C22C 38/005* (2013.01); *C22C 38/06* (2013.01); *C22C 38/10* (2013.01); *C22C 38/14* (2013.01); *C22C 38/16* (2013.01); *C22C 38/42* (2013.01); *H01F 1/0577* (2013.01); *H01F 41/0266* (2013.01); *H01F 41/0293* (2013.01); *B22F 2998/10* (2013.01); *C22C 2202/02* (2013.01)

(56) References Cited

U.S. PATENT DOCUMENTS

| | | | | |
|---|---|---|---|---|
| 2006/0165550 | A1* | 7/2006 | Enokido | H01F 1/057 420/40 |
| 2007/0240789 | A1* | 10/2007 | Nakamura | H01F 41/0293 148/101 |
| 2010/0045411 | A1* | 2/2010 | Kobayashi | B22F 7/02 335/302 |
| 2010/0233016 | A1* | 9/2010 | Tsubokura | C22C 33/0278 420/83 |
| 2012/0299675 | A1 | 11/2012 | Honkura et al. | |
| 2013/0284969 | A1* | 10/2013 | Kim | H01F 1/01 252/62.57 |

FOREIGN PATENT DOCUMENTS

| | | | | |
|---|---|---|---|---|
| EP | 1845539 | A2 | | 10/2007 |
| EP | 1860668 | A1 | | 11/2007 |
| EP | 1923893 | A1 | | 5/2008 |
| EP | 1970924 | A1 | | 9/2008 |
| JP | 1-219143 | A | | 9/1989 |
| JP | 7-176414 | A | | 7/1995 |
| JP | 7283016 | A | | 10/1995 |
| JP | 2002-83730 | A | | 3/2002 |
| JP | 2003-31409 | A | | 1/2003 |
| JP | 3405806 | B2 | | 5/2003 |
| JP | 2006249547 | A | * | 9/2006 |
| JP | 2007-217741 | A | | 8/2007 |
| JP | 1923893 | A1 | | 5/2008 |
| JP | 2012-28704 | A | | 2/2012 |
| JP | 2012-234985 | A | | 11/2012 |
| JP | 2013-225533 | A | | 10/2013 |
| WO | 2011/070827 | A1 | | 6/2001 |
| WO | 2009/122709 | A1 | | 10/2009 |
| WO | 2011/004894 | A1 | | 1/2011 |
| WO | 2011/070827 | A1 | | 6/2011 |

OTHER PUBLICATIONS

Communication dated Jan. 30, 2015 from the European Patent Office in counterpart application No. 14001450.7.
Communication dated Dec. 25, 2015, issued by the State Intellectual Property Office of the P.R.C. in corresponding Chinese Application No. 201410156464.1.
Communication dated Jul. 22, 2016 from the State Intellectual Property Office of the P.R.C. in counterpart Application No. 201410156464.1.
Communication dated Mar. 21, 2017 from the Japanese Patent Office in counterpart application No. 2013-151073.

* cited by examiner

R-T-B RARE EARTH SINTERED MAGNET AND METHOD OF MANUFACTURING THE SAME

BACKGROUND OF THE INVENTION

Field of the Invention

The present invention relates to an R-T-B rare earth sintered magnet and a method of manufacturing the R-T-B rare earth sintered magnet, and particularly, to a method of manufacturing an R-T-B rare earth sintered magnet having excellent magnetic properties.

Priority is claimed on Japanese Patent Application No. 2013-089744, filed on Apr. 22, 2013, and Japanese Patent Application No. 2013-151073, filed on Jul. 19, 2013, the contents of which are incorporated herein by reference.

Description of Related Art

Hitherto, R-T-B rare earth sintered magnets (hereinafter, may be referred to as "R-T-B magnet") have been used in voice coil motors of hard disk drives and motors for engines of hybrid automobiles and electric automobiles.

In general, in R-T-B magnets, R is Nd, a part of which is replaced by other rare earth elements such as Pr, Dy, and Tb. T is Fe, a part of which is replaced by other transition metals such as Co and Ni. B is boron and a part thereof can be replaced by C or N.

Normal R-T-B magnets have a structure constituted mainly by a main phase consisting of $R_2T_{14}B$ and an R-rich phase which is present at the grain boundaries of the main phase and has a higher Nd concentration than the main phase. The R-rich phase is also referred to as a grain boundary phase.

Japanese Patent No. 3405806 proposes a method of infiltrating a melted alloy for infiltration into a compact of a powder of an alloy for an R-T-B magnet, as a method of improving the coercivity of the R-T-B magnet.

PCT International Publication No. WO2011/070827 proposes a manufacturing method including: pressurizing a mixed raw material made by mixing a magnet raw material and a diffusion raw material to form a compact; and heating the compact.

Japanese Unexamined Patent Application, First Publication No. H7-176414 proposes a manufacturing method including: molding a mixture of a powder of a mother alloy for a main phase and a powder of a mother alloy for a grain boundary phase; and sintering the resulting molded product.

When R-T-B magnets are used at a temperature equal to or higher than the room temperature, coercivity (Hcj) decreases with an increase in temperature. The coercivity (Hcj) of R-T-B magnets is improved when heavy rare earth elements such as Dy and Tb is contained. Therefore, in conventional R-T-B magnets, a heavy rare earth element is added to achieve coercivity in an operation temperature range. In addition, it is required to further improve the coercivity of R-T-B magnets in order to increase the efficiency of generators or motors.

However, heavy rare earth element can be mined only in the limited place. Furthermore, heavy rare earth element reserves are smaller than reserves of light rare earth elements such as Nd and Pr. Therefore, when a large amount of heavy rare earth elements is used, the balance between the demand and the supply of heavy rare earth elements is disrupted and this leads to a sharp rise in price. Moreover, it becomes difficult to stably secure a required amount. Therefore, it is required to provide R-T-B magnets having high coercivity without using heavy rare earth elements as much as possible.

SUMMARY OF THE INVENTION

The invention is contrived in view of the circumstances, and an object thereof is to provide an R-T-B magnet having high coercivity in which the amount of heavy rare earth elements used is suppressed, and a method of manufacturing the R-T-B magnet.

The inventors of the invention have repeatedly conducted intensive studies to achieve the object.

As a result, they have found that in sintering of a compact of an alloy powder for an R-T-B magnet, when an alloy material containing a grain boundary phase component is disposed together with the compact in a chamber of a sintering furnace and sintering is then performed, coercivity is improved.

In this case, the grain boundary phase component including a larger amount of R than the main phase is supplied from the alloy material to the compact during the sintering. The grain boundary phase component supplied to the compact is diffused to peripheries of main phase grains having a composition of $R_2Fe_{14}B$. The resulting R-T-B magnet obtained after the sintering has a state in which the main phase grains are isolated by the grain boundary phase surrounding the main phase grains. In such an R-T-B magnet, magnetic domain reversal is suppressed due to the isolation of the main phase grains. Therefore, excellent coercivity is obtained.

The inventors of the invention have devised the invention based on the above-described knowledge.

(1) According to an aspect of the invention, a method of manufacturing an R-T-B rare earth sintered magnet, including a molding step of forming a compact of a first alloy powder, and a sintering step of disposing and sintering the compact and an alloy material of a second alloy in a chamber of a sintering furnace to turn the compact into a sintered body, wherein the first alloy consists of R which represents a rare earth element, T which represents a transition metal essentially containing Fe, B, Cu, and inevitable impurities; wherein the first alloy contains 11 at % to 17 at % of R, 4.5 at % to 6 at % of B, and T as the balance, and wherein the second alloy consists of R which represents a rare earth element, T which represents a transition metal essentially containing Fe, B, and inevitable impurities; wherein the second alloy contains 11 at % to 20 at % of R, 4.5 at % to 6 at % of B, and T as the balance.

(2) The method of manufacturing an R-T-B rare earth sintered magnet according to (1), in which the first alloy may contain 0.05 at % to 0.2 at % of Cu.

(3) The method of manufacturing an R-T-B rare earth sintered magnet according to (1) or (2), in which the first alloy may contain 0 at % to 1.6 at % of a metal element M which represents Al and/or Ga.

(4) The method of manufacturing an R-T-B rare earth sintered magnet according to any one of (1) to (3), in which Dy content in all of the rare earth elements of the first alloy may be 0 at % to 29 at %.

(5) The method of manufacturing an R-T-B rare earth sintered magnet according to (4), in which the first alloy may contain 13.5 at % to 17 at % of R without containing Dy.

(6) The method of manufacturing an R-T-B rare earth sintered magnet according to any one of (1) to (5), in which the second alloy may contain 0.05 at % to 0.2 at % of Cu.

(7) The method of manufacturing an R-T-B rare earth sintered magnet according to any one of (1) to (6), in which the second alloy may contain 0 at % to 1.6 at % of a metal element M which represents Al and/or Ga.

(8) The method of manufacturing an R-T-B rare earth sintered magnet according to any one of (1) to (7), in which Dy content in all of the rare earth elements of the second alloy may be 0 at % to 29 at %.

(9) The method of manufacturing an R-T-B rare earth sintered magnet according to (8), in which the second alloy may contain 13.5 at % to 17 at % of R without containing Dy.

(10) The method of manufacturing an R-T-B rare earth sintered magnet according to any one of (1) to (9), wherein the second alloy may be formed of a main phase composed of $R_2T_{14}B$ and a grain boundary phase including a larger amount of R than the main phase, and the ratio of the grain boundary phase contained in the second alloy is 6 mass % or greater and less than 15 mass %.

(11) The method of manufacturing an R-T-B rare earth sintered magnet according to any one of (1) to (10), in which in the sintering step, the sintering may be performed for 30 minutes to 180 minutes at 800° C. to 1150° C.

(12) According to another aspect of the invention, an R-T-B rare earth sintered magnet comprising R which represents a rare earth element, T which represents a transition metal essentially containing Fe, B, Cu, and inevitable impurities; wherein the R-T-B rare earth sintered magnet contains 11 at % to 20 at % of R, 4.5 at % to 6 at % of B, and T as the balance, wherein the R-T-B rare earth sintered magnet is formed of a sintered body having a main phase composed of $R_2Fe_{14}B$ and a grain boundary phase including a larger amount of R than the main phase, and wherein the ratio of the area of the grain boundary phase per unit area in an area, which is 0.5 mm or greater away from the outer surface inside the sintered body, is 10% to 20%.

(13) The R-T-B rare earth sintered magnet according to (12), in which the R-T-B rare earth sintered magnet may contain 0.05 at % to 0.2 at % of Cu.

(14) The R-T-B rare earth sintered magnet according to (12) or (13), in which the R-T-B rare earth sintered magnet may contain 0 at % to 1.6 at % of a metal element M which represents Al and/or Ga.

(15) The R-T-B rare earth sintered magnet according to any one of (12) to (14), in which Dy content in all of the rare earth elements of the R-T-B rare earth sintered magnet may be 0 at % to 29 at %.

(16) The R-T-B rare earth sintered magnet according to any one of (12) to (15), in which the grain boundary phase may include an R-rich phase in which a total atomic concentration of the rare earth element is 70 at % or greater and a transition metal-rich phase in which a total atomic concentration of the rare earth element is 25 at % to 35 at %.

(17) The R-T-B rare earth sintered magnet according to any one of (12) to (16), wherein the change in the ratio of an area of the grain boundary phase per unit area between an area which is 0.5 mm away from an outer surface inside the sintered body and an area which is 10 mm away from the outer surface inside the sintered body may be 10% or less.

Since the method of manufacturing an R-T-B rare earth sintered magnet according to the above aspect of the invention includes a sintering process of disposing the compact of the powder of the first alloy and the second alloy (alloy material) in a chamber of a sintering furnace to sinter the compact, main phase grains are isolated by the grain boundary phase surrounding the main phase grains, and thus an R-T-B rare earth sintered magnet having excellent coercivity is obtained.

DETAILED DESCRIPTION OF THE INVENTION

Figure 1:
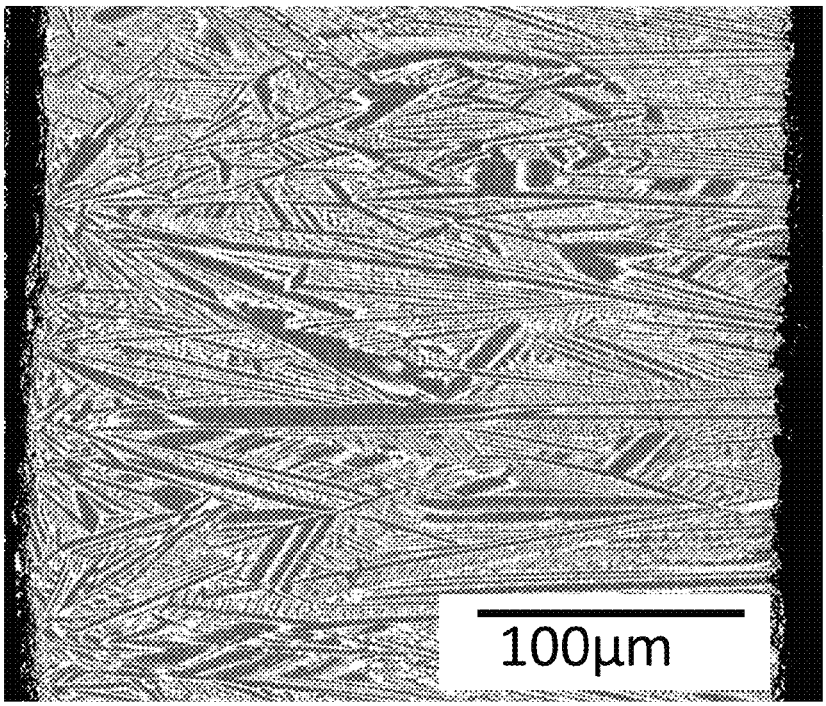
FIG. 1 is a microphotograph of an alloy flake for an R-T-B magnet.

Hereinafter, embodiments of the invention will be described in detail.

R-T-B Magnet

An R-T-B rare earth sintered magnet (hereinafter, abbreviated as "R-T-B magnet") of this embodiment is manufactured using a method of manufacturing an R-T-B magnet of the invention.

The R-T-B magnet of this embodiment has a composition containing R which is a rare earth element, T which is a transition metal essentially containing Fe, a metal element M which is Al and/or Ga, B, Cu, and inevitable (unavoidable) impurities. The R-T-B magnet of this embodiment contains 11 at % to 20 at % of R, 4.5 at % to 6 at % of B, 0 at % to 1.6 at % of M, and the balance T, and the proportion of Dy in all of the rare earth elements is 0 at % to 29 at %. The R-T-B magnet of this embodiment may contain 0.05 at % to 1.0 at % of Zr and/or Nb.

When the content of R which is a rare earth element is 11 at % or greater, an R-T-B magnet having high coercivity is obtained. The amount of R is preferably 13.5 at % or greater. When the amount of R is greater than 20 at %, remanence of the R-T-B magnet becomes low, and thus an inadequate magnet is obtained. The amount of R is 20 at % or less, and preferably 17 at % or less.

The amount of Dy in all of the rare earth elements is 0 at % to 29 at %. In the R-T-B magnet of this embodiment, main phase grains are isolated by a grain boundary phase surrounding the main phase grains. Thus, the R-T-B magnet of this embodiment obtains excellent coercivity. Accordingly, the R-T-B magnet of this embodiment may contain no Dy. When Dy is contained, a sufficiently high coercivity improving effect is obtained when a Dy content in all of the rare earth elements is 29 at % or less. The amount of Dy content in all of the rare earth elements is preferably 0 at % to 15 at %. Even when the amount of Dy content in all of the rare earth elements is 15 at % or less, sufficiently high coercivity of approximately 25 kOe is obtained.

Examples of the rare earth element R other than Dy of the R-T-B magnet include Sc, Y, La, Ce, Pr, Nd, Pm, Sm, Eu, Gd, Tb, Ho, Er, Tm, Yb, and Lu. Among the rare earth elements R, Nd, Pr, and Tb are particularly preferably used. In addition, the rare earth element R preferably contains Nd as a main component.

B contained in the R-T-B magnet is boron and a part thereof can be replaced by C or N. The amount of B is 4.5 at % to 6 at %. The amount of B is preferably 4.8 at % or greater, and preferably 5.5 at % or less. Sufficient coercivity is obtained when the amount of B contained in the R-T-B magnet is adjusted to 4.5 at % or greater. In addition, when the amount of B is adjusted to 6 at % or less, the generation of $RT_4B_4$ can be suppressed in the process of manufacturing the R-T-B magnet.

The R-T-B magnet of this embodiment contains 0 at % to 1.6 at % of the metal element M which is Al and/or Ga. The amount of the metal element M is preferably 0.1 at % or greater. The amount of the metal element M is preferably 1.4 at % or less.

When the amount of the metal element M is adjusted to 0.1 at % or greater, a transition metal-rich phase is easily generated in the process of manufacturing the R-T-B magnet. When the transition metal-rich phase is generated, a coercivity improving effect is obtained as will be described later.

A reduction in remanence occurs when Al atoms enter the main phase. In the case in which the metal element M is Al, when the content of Al is 1.6 at % or less, the amount of the reduction in remanence can be adjusted within an allowable range even when Al atoms enter the main phase in the process of manufacturing the R-T-B magnet.

In addition, the metal element M is preferably Ga, because Ga does not enter the main phase, but easily enters the transition metal-rich phase. When the metal element M is Ga, the coercivity improving effect is saturated and the coercivity is not further improved even when the content of Ga is greater than 1.6 at %.

Cu contained in the R-T-B magnet of this embodiment has an effect of improving the coercivity by isolating the main phase grains by the grain boundary phase. The amount of Cu is preferably 0.05 at % to 0.2 at %. When 0.05 at % or greater of Cu is contained, the grain boundary phase component supplied from a second alloy to be described later to a compact is diffused to peripheries of the main phase grains in a sintering process. As a result, the main phase grains are isolated and excellent coercivity is obtained. Furthermore, the grain boundary phase is uniformly distributed in the R-T-B magnet and a variation in coercivity can be reduced. When Cu is not contained, the main phase grains are not isolated in the sintering process and excellent magnetic properties are not obtained. In addition, sintering of the R-T-B magnet is easily performed when 0.05 at % or greater of Cu is contained. When the amount of Cu is 0.2 at % or less, the generation of an R-T-Cu phase which decreases the coercivity upon sintering can be suppressed.

T contained in the R-T-B magnet is a transition metal essentially containing Fe. Group 3 elements to Group 11 elements can be used as transition metals other than Fe contained in T of the R-T-B magnet.

T of the R-T-B magnet preferably contains Co other than Fe, because a Curie temperature (Tc) can be improved.

The R-T-B magnet of this embodiment may contain 0.05 at % to 1.0 at % of Zr and/or Nb. The R-T-B magnet preferably contains 0.05 at % to 1.0 at % of Zr and/or Nb, because abnormal grain growth of the main phase upon sintering can be prevented. When the amount of Zr and/or Nb is less than 0.05 at %, effects of Zr and/or Nb cannot be sufficiently obtained. Accordingly, the amount of Zr and/or Nb is preferably 0.05 at % or greater, and more preferably 0.1 at % or greater. In addition, when the amount of Zr and/or Nb is adjusted to 1.0 at % or less, and more preferably 0.5 at % or less, a reduction in remanence due to the addition of Zr and/or Nb can be avoided.

The R-T-B magnet of this embodiment is formed of a sintered body having a main phase of $R_2Fe_{14}B$ and a grain boundary phase including a larger amount of R than the main phase.

In the R-T-B magnet of this embodiment, the grain boundary phase preferably includes an R-rich phase in which a total atomic concentration of the rare earth element R is 70 at % or greater and a transition metal-rich phase in which the total atomic concentration of the rare earth element R is 25 at % to 35 at %.

In this embodiment, the transition metal-rich phase preferably contains 50 at % to 70 at % of T which is a transition metal essentially containing Fe. The transition metal-rich phase mainly contains an $R_6T_{13}M$-type metal compound. Accordingly, the atomic concentration of T contained in the transition metal-rich phase becomes close to 65 at % corresponding to the composition ratio of T of the $R_6T_{13}M$-type metal compound. When the atomic concentration of T in the transition metal-rich phase is 50 at % to 70 at %, the coercivity (Hcj) improving effect of the transition metal-rich phase is more effectively obtained. However, when the atomic concentration of T in the transition metal-rich phase is greater than the foregoing range, there is a concern that the excessive T may be precipitated as an $R_2T_{17}$ phase or a T atom simple substance and cause adverse effects on the magnetic properties.

In the R-T-B magnet of this embodiment, the grain boundary phase is uniformly distributed. The amount of change (change, difference) in the grain boundary phase area ratio between a position which is positioned inside by a distance of 0.5 mm from the outer surface of the magnet and a position which is positioned inside by a distance of 10 mm from the foregoing outer surface is 10% or less. When the amount of change is 10% or less, the variation in magnet properties is sufficiently reduced. The amount of change is preferably 6% or less, and more preferably 4% or less.

Here, the grain boundary phase area ratio is a value obtained by observing the cross-section of the magnet and by calculating the area of the grain boundary phase per unit area.

The higher the grain boundary phase area ratio, the easier the isolation of the main phase grains by the grain boundary phase surrounding the main phase grains, and thus high coercivity is obtained. The ratio of an area of the grain boundary phase per unit area at the area, which is 0.5 mm or greater away from the outer surface inside the magnet, is preferably 10% or greater, and more preferably 12% or greater. In addition, the grain boundary phase has no magnetic properties or weaker magnetic properties than the main phase. Thus, the higher the grain boundary phase area ratio, the lower the remanence. Therefore, the grain boundary phase area ratio of the area which is positioned inside by a distance of 0.5 mm or greater from the outer surface is preferably 20% or less, and more preferably 15% or less.

Method of Manufacturing R-T-B Magnet

In a method of manufacturing an R-T-B magnet of this embodiment, first, a first alloy as an alloy for an R-T-B magnet which is used as a material of a compact before sintering is prepared.

The first alloy consists of R which is a rare earth element, T which is a transition metal essentially containing Fe, a metal element M which is Al and/or Ga, B, Cu, and unavoidable impurities. The first alloy contains 11 at % to 17 at % of R, 4.5 at % to 6 at % of B, 0 at % to 1.6 at % of M, and the balance T, and the proportion of Dy in all of the rare earth elements is 0 at % to 29 at %. The first alloy may contain 0.05 at % to 1.0 at % of Zr or Nb.

When the amount of R which is a rare earth element is 11 at % or greater, an R-T-B magnet having high coercivity is obtained. The amount of R is preferably 13.5 at % or greater. When the content of R is greater than 17 at %, remanence of the R-T-B magnet obtained after sintering is reduced, and thus an inadequate magnet is obtained. The amount of R is 17 at % or less, and preferably 16 at % or less.

In the first alloy, the amount of Dy in all of the rare earth elements is 0 at % to 29 at %. In this embodiment, a sintering process to be described later is performed to isolate the main phase grains to thus improve the coercivity. Therefore, the first alloy may contain no Dy. When the first alloy contains Dy, a sufficiently high coercivity improving effect is obtained when a Dy content in all of the rare earth elements is 29 at % or less. The amount of Dy content in all of the rare earth elements is preferably 0 at % to 15 at %.

Examples of the rare earth element R other than Dy of the first alloy include Sc, Y, La, Ce, Pr, Nd, Pm, Sm, Eu, Gd, Tb, Ho, Er, Tm, Yb, and Lu. Among the rare earth elements R, Nd, Pr, and Tb are particularly preferably used. In addition, the rare earth element R preferably contains Nd as a main component.

B contained in the first alloy is boron and a part thereof can be replaced by C or N. The amount of B is 4.5 at % to 6 at %. The amount of B is preferably 5.2 at % or greater, and preferably 5.6 at % or less. An R-T-B magnet having high coercivity is obtained when the amount of B contained in first alloy is adjusted to 4.5 at % or greater. In addition, when the amount of B is adjusted to 6 at % or less, the generation of $RT_4B_4$ can be suppressed in the process of manufacturing the R-T-B magnet.

The first alloy of this embodiment contains 0 at % to 1.6 at % of the metal element M which is Al and/or Ga. The content of the metal element M is preferably 0.1 at % or greater. The amount of the metal element M is preferably 1.4 at % or less.

When the content of the metal element M is adjusted to 0.1 at % or greater, a transition metal-rich phase is easily generated in the process of manufacturing the R-T-B magnet. When the transition metal-rich phase is generated, a coercivity improving effect is obtained.

A reduction in remanence occurs when Al atoms enter the main phase. In the case in which the metal element M represents Al, when the amount of Al is 1.6 at % or less, the amount of the reduction in remanence can be adjusted within an allowable range even when Al atoms enter the main phase in the process of manufacturing the R-T-B magnet.

In addition, the metal element M is preferably Ga, because Ga does not enter the main phase, but easily enters the transition metal-rich phase. When the metal element M is Ga, the coercivity improving effect is saturated and the coercivity is not further improved even when the content of Ga is greater than 1.6 at %.

Cu contained in the first alloy of this embodiment has an effect of improving the coercivity by isolating the main phase grains by the grain boundary phase. The amount of Cu contained in the first alloy is preferably 0.05 at % to 0.2 at %. When 0.05 at % or greater of Cu is contained, the grain boundary phase component supplied from a second alloy to be described later to a compact is diffused to peripheries of the main phase grains in the sintering process. As a result, the main phase grains are isolated and excellent coercivity is obtained. Furthermore, the grain boundary phase is uniformly distributed in the R-T-B magnet and a variation in coercivity can be reduced. When Cu is not contained, the main phase grains are not isolated in the sintering process and excellent magnetic properties are not obtained. In addition, sintering of the R-T-B magnet is easily performed when 0.05 at % or greater of Cu is contained. When the amount of Cu is 0.2 at % or less, the generation of an R-T-Cu phase which decreases the coercivity upon sintering can be suppressed.

T contained in the first alloy is a transition metal essentially containing Fe. Group 3 elements to Group 11 elements can be used as transition metals other than Fe contained in T of the first alloy. T of the first alloy preferably contains Co as the transition metal other than Fe, because a Curie temperature (Tc) can be improved.

The first alloy of this embodiment may contain 0.05 at % to 1.0 at % of Zr and/or Nb. The first alloy preferably contains 0.05 at % to 1.0 at % of Zr and/or Nb, because abnormal grain growth of the main phase upon sintering can be prevented. When the amount of Zr and/or Nb is less than 0.05 at %, effects of Zr and/or Nb cannot be sufficiently obtained. Accordingly, the amount of Zr and/or Nb is preferably 0.05 at % or greater, and more preferably 0.1 at % or greater. In addition, when the amount of Zr and/or Nb is adjusted to 1.0 at % or less, and more preferably 0.5 at % or less, a reduction in remanence due to the addition of Zr and/or Nb can be avoided.

In the method of manufacturing an R-T-B magnet of this embodiment, a second alloy which is used as an alloy material which is disposed together with a compact in a chamber of a sintering furnace is prepared.

The second alloy consists of R which is a rare earth element, T which is a transition metal essentially containing Fe, a metal element M which is Al and/or Ga, B, and unavoidable impurities. The second alloy contains 11 at % to 20 at % of R, 4.5 at % to 6 at % of B, 0 at % to 1.6 at % of M, and the balance T, and the proportion of Dy in all of the rare earth elements is 0 at % to 29 at %.

The second alloy may contain 0.05 at % to 1.0 at % of Zr or Nb in addition to the above-described elements. The second alloy may contain 0.05 at % to 0.2 at % of Cu in addition to the foregoing elements.

When the content of R which is a rare earth element is 11 at % or greater, a required amount of a grain boundary phase component including a larger amount of R than the main phase is supplied from the alloy material which is the second alloy to the compact. Accordingly, after sintering, the main phase grains are isolated by the grain boundary phase, and an R-T-B magnet having high coercivity is obtained. The amount of R is more preferably 13.5 at % or greater. When the amount of R is greater than 20 at %, remanence of the R-T-B magnet obtained after sintering is reduced. The amount of R is 20 at % or less, and is preferably 17 at % or less.

In the second alloy, the amount of Dy in all of the rare earth elements is 0 at % to 29 at %. In this embodiment, a sintering process to be described later is performed to isolate the main phase grains to thus improve the coercivity of the R-T-B magnet. Therefore, the second alloy may contain no Dy. When the second alloy contains Dy, a sufficiently high coercivity improving effect is obtained when a Dy content in all of the rare earth elements is 29 at % or less. The amount of Dy content in all of the rare earth elements is preferably 0 at % to 15 at %.

Examples of the rare earth element R other than Dy of the second alloy include Sc, Y, La, Ce, Pr, Nd, Pm, Sm, Eu, Gd, Tb, Ho, Er, Tm, Yb, and Lu. Among the rare earth elements R, Nd, Pr, and Tb are particularly preferably used. In addition, the rare earth element R preferably contains Nd as a main component.

B contained in the second alloy is boron and a part thereof can be replaced by C or N. The amount of B is 4.5 at % to 6 at %. The amount of B is preferably 5.2 at % or greater, and preferably 5.6 at % or less. When the amount of B contained in second alloy is adjusted to 4.5 at % or greater, the precipitation of $R_2$-$T_{17}$ is prevented and an alloy appropriate for supplying a grain boundary phase component to a compact during the sintering process is obtained. As a result, an R-T-B magnet having high coercivity is obtained after the sintering process. In addition, when the amount of B is adjusted to 6 at % or less, the precipitation of boride is prevented and an alloy appropriate for supplying a grain boundary phase component to a compact during the sintering process is obtained.

The second alloy of this embodiment contains 0 at % to 1.6 at % of the metal element M which is Al and/or Ga. The amount of the metal element M is preferably 0.1 at % or greater. The amount of the metal element M is preferably 1.4 at % or less. When the amount of the metal element M is small, the proportion of an R-rich phase in the grain boundary phase component which is supplied from the second alloy to the compact upon sintering increases. In addition, with an increase in the amount of the metal element M, the amount of T and M which are supplied from the second alloy to the compact upon sintering increases, and the amount of a transition metal-rich phase which is generated in the compact increases.

However, when the amount of the metal element M is greater than 1.6 at %, the grain boundary phase component which is generated in the second alloy is reduced, and thus it becomes difficult to supply a required amount of the grain boundary phase component from the second alloy to the first alloy.

When the second alloy of this embodiment contains Cu, the content thereof is preferably 0.05 at % to 0.2 at %. When 0.05 at % to 0.2 at % of Cu is contained, the grain boundary phase component can be efficiently supplied from the alloy material which is the second alloy to the compact in the sintering process. When the amount of Cu is less than 0.05 at %, effects of Cu in the second alloy may not be sufficiently obtained. The amount of Cu is preferably 0.2 at % or less, because the amount of an R-T-Cu phase, which decreases the coercivity, generated in the transition metal-rich phase generated in the compact can be suppressed so that adverse effects are not caused.

T contained in the second alloy is a transition metal essentially containing Fe. Group 3 elements to Group 11 elements can be used as transition metals other than Fe contained in T of the second alloy.

The second alloy is formed of a main phase having a composition of $R_2T_{14}B$ and a grain boundary phase including a larger amount of R than the main phase. The proportion of the grain boundary phase included in the second alloy is preferably 6 mass % or greater and less than 15 mass %. The second alloy in which 6 mass % or greater and less than 15 mass % of the grain boundary phase is included can supply a required amount of a grain boundary phase component to a compact in the sintering process. Therefore, the main phase grains of the R-T-B magnet obtained after the sintering can be isolated. Even when the grain boundary phase included in the second alloy is 15 mass % or greater, an improvement of the effect of improving the coercivity of the R-T-B magnet obtained after sintering cannot be shown.

The amount of the grain boundary phase in the second alloy can be calculated based on the composition of the second alloy. Specifically, since the composition of the main phase is $R_2T_{14}B$, the amount of the main phase in the alloy is determined by the amount of B and the remaining phase is the grain boundary phase.

In this embodiment, the composition of the first alloy and the composition of the second alloy may be the same as, or different from each other.

Next, cast alloy flakes having the composition of the above-described first alloy are manufactured using the following method. Cast alloy flakes having the composition of the above-described second alloy can be manufactured in the same manner as the cast alloy flakes having the composition of the first alloy, except that a molten alloy having the composition of the second alloy is used.

First, a molten alloy having the composition of the above-described first alloy (or second alloy) is supplied to a cooling roll and then solidified through a strip cast (SC) method to manufacture a cast alloy (casting process).

In this embodiment, the molten alloy having the above-described composition is prepared at a temperature of, for example, 1200° C. to 1500° C. Next, the obtained molten alloy is supplied to the cooling roll using a tundish and is then solidified to separate a cast alloy from the cooling roll at 400° C. to 800° C. The obtained cast alloy has an average thickness of 0.15 mm to 0.50 mm.

In this embodiment, the temperature of the cast alloy separated from the cooling roll is preferably 400° C. to 800° C. In this case, the interval between the grain boundary phases can be adjusted to be approximately the same as the grain diameter of the powder used in the preparation of the compact.

In this embodiment, in the casting process, a cast alloy having an average thickness of 0.15 mm to 0.50 mm is preferably manufactured. The average thickness of the cast alloy is more preferably 0.18 mm to 0.35 mm. When the average thickness of the cast alloy is 0.15 mm to 0.50 mm, the temperature of the cast alloy which is separated from the cooling roll is preferably adjusted to 400° C. to 800° C., because the grain boundary phase in the cast alloy is uniformly distributed and the interval between the adjacent grain boundary phases becomes 1 μm to 10 μm. It is not preferable that the average thickness of the cast alloy be greater than 0.50 mm, because the cast alloy is not sufficiently cooled, and thus Fe is precipitated in the cast alloy and pulverizability thus deteriorates. In addition, it is not preferable that the average thickness of the cast alloy be less than 0.15 mm, because the interval between the grain boundary phases in the cast alloy is reduced, and thus it becomes difficult to control the grain diameter of the powder in the pulverization process.

In this embodiment, the average cooling rate up to when the molten alloy supplied to the cooling roll is separated from the cooling roll as the cast alloy is preferably 800° C./s to 1000° C./s, and more preferably 850° C./s to 980° C./s. The average cooling rate is preferably 800° C./s to 1000° C./s, because the temperature of the cast alloy separated from the cooling roll can be easily adjusted to 400° C. to 800° C., and the interval between the grain boundary phases can be adjusted to be approximately the same as the grain diameter of the powder used in the preparation of the compact. It is not preferable that the average cooling rate be less than 800° C./s, because Fe is precipitated in the cast alloy and pulverizability thus significantly deteriorates. In addition, it is not preferable that the average cooling rate be greater than 1000° C./s, because the crystallinity of the main phase becomes poor.

The obtained cast alloy is crushed into cast alloy flakes having the composition of the first alloy (or second alloy).

The cast alloy flakes having the composition of the second alloy obtained as described above can be used as is as an alloy material which is disposed in a chamber. In addition, the cast alloy flakes having the composition of the second alloy may be used as an alloy material after pulverization into a powder, as in the case of the cast alloy flakes having the composition of the first alloy. The shape of the alloy material which is used in this embodiment is not particularly limited.

In addition, the cast alloy flakes having the composition of the first alloy are cracked using a hydrogen decrepitation method or the like and pulverized using a pulverizer such as a jet mill to obtain a powdery R-T-B alloy.

The hydrogen decrepitation method is performed in the following order. First, hydrogen is absorbed at room temperature in cast alloy flakes. Next, the cast alloy flakes absorbing the hydrogen are heat-treated in the hydrogen at a temperature of approximately 300° C. Then, a heat treatment is performed at a temperature of approximately 500° C. under reduced pressure to remove the hydrogen in the cast alloy flakes. In the hydrogen decrepitation method, the cast alloy flakes absorbing the hydrogen are expanded in volume, and thus a large number of cracks are caused in the alloy and the decrepitation is easily performed.

The grain diameter (d50) of the powder of the first alloy obtained as described above is preferably 3.5 μm to 4.5 μm. The grain diameter of the powder of the first alloy is preferably within the foregoing range, because the oxidation of the first alloy during the manufacturing process can be prevented.

In this embodiment, 0.02 mass % to 0.03 mass % of zinc stearate as a lubricant is added to the powder of the first alloy which is an R-T-B alloy, and the resulting material is subjected to press molding using a molding machine or the like in a transverse magnetic field to form a compact (molding process).

Thereafter, the compact of the powder of the first alloy and the alloy material of the second alloy are disposed and sintered in a chamber of a sintering furnace to turn the compact into a sintered body (sintering process).

In the sintering process, the alloy material of the second alloy is preferably disposed over the entire surface in the chamber when viewed from the top. When the alloy material is disposed over the entire surface in the chamber when viewed from the top, a vapor of the grain boundary phase component is uniformly supplied from the alloy material to the inside of the chamber. As a result, the grain boundary phase component can be uniformly diffused to the compact.

In addition, the alloy material of the second alloy is preferably disposed to cover the entire upper surface of the compact. The compact may be contaminated by oil or oxygen during the sintering process. When the alloy material is disposed to cover the entire upper surface of the compact and the sintering process is performed, the contamination of the compact in the sintering process can be prevented.

The alloy material of the second alloy may be disposed in the chamber, disposed in contact with the compact, or disposed to be separated from the compact.

In the sintering process, the sintering is preferably performed for 30 minutes to 180 minutes at a temperature of 800° C. to 1150° C. When the sintering temperature and the sintering time are within the foregoing ranges, a vapor of the grain boundary phase component is supplied from the alloy material of the second alloy to the compact. In addition, the grain boundary phase component supplied to the compact is diffused to surround the peripheries of the main phase grains. As a result, the sintered body obtained after the sintering has a state in which the main phase grains are isolated by the grain boundary phase surrounding the main phase grains.

When the sintering temperature is 800° C. or higher, the grain boundary phase component in the second alloy is easily melted or vaporized, and thus the main phase grains of the sintered body can be isolated. Therefore, the sintering temperature is preferably 800° C. or higher, more preferably 900° C. or higher, and even more preferably 1010° C. or higher. In addition, when the sintering temperature is 1150° C. or lower, grain growth of the main phase of the first alloy can be prevented. Accordingly, the sintering temperature is preferably 1150° C. or lower, and more preferably 1100° C. or lower.

When the sintering time is shorter than 30 minutes, there is a concern that the sintering may not be sufficiently performed. Therefore, the sintering time is preferably 30 minutes or longer. In addition, when the sintering time is 180 minutes or shorter, the growth of the main phase grains is prevented, and the coercivity and the squareness of the R-T-B magnet can be maintained. Accordingly, the sintering time is preferably 180 minutes or shorter.

In addition, when the sintering temperature and the sintering time are within the foregoing ranges, the alloy material does not adhere to the sintered body obtained after the sintering even when the alloy material of the second alloy is disposed in contact with the sintered body. Accordingly, the alloy material disposed in contact with the compact can be easily peeled from the surface of the sintered body after the sintering process. Accordingly, after the sintering, there is no need to scrape off the alloy material from the sintered body.

When the sintering is performed, the atmosphere in the chamber is preferably either a vacuum or filled with argon gas to prevent damage caused by the oxidation of the compact.

In addition, in the sintering process, the compact of the first alloy powder and the alloy material of the second alloy may be installed in a tray made of carbon, and the tray into which the compact and the alloy material are put may be disposed in the chamber of the sintering furnace to perform sintering. The tray is preferably used, because the adhesion of the grain boundary phase component to the inner wall of the chamber of the sintering furnace can be suppressed, and thus the grain boundary phase component can be efficiently supplied from the alloy material to the compact.

The sintered body obtained after the sintering is then heat-treated if necessary, and is thus turned into an R-T-B magnet.

The heat treatment after the sintering is performed if necessary to uniformly cover the main phase surface of the R-T-B magnet by the grain boundary phase. The heat treatment temperature may consist of one step (stage) or two steps (stages). That is, the heat treatment may be performed in a fixed temperature range, or the heat treatment may include two steps and be performed by changing the temperature range at every step. In the case of two steps, for example, the heat treatment can be performed at a temperature of 600° C. to 850° C. in the first step, and performed at a temperature of 300° C. to 600° C. in the second step. The heat treatment time in each of the first step and the second step is preferably 30 minutes to 180 minutes.

According to the method of manufacturing an R-T-B magnet of this embodiment, since the compact of the powder of the first alloy and the alloy material of the second alloy are disposed and sintered in a chamber of a sintering furnace, the obtained magnet has the above-described composition, the amount of change in the grain boundary phase area ratio between an area which is positioned inside by a distance of 0.5 mm from an outer surface and an area which is positioned inside by a distance of 10 mm from the foregoing outer surface is 10% or less, and main phase grains are isolated by the grain boundary phase surrounding the main phase grains.

In such an R-T-B magnet, since the proportion of the grain boundary phase in the magnet is uniform, a variation in coercivity is small, and the main phase grains are isolated by the grain boundary phase surrounding the main phase grains. Thus, excellent coercivity is obtained. Accordingly, the R-T-B magnet can be appropriately used in motors and the like.

EXAMPLES

Test Examples 1 to 12 and 51 to 54

A Nd metal (having a purity of 99 wt % or greater), a Pr metal (having a purity of 99 wt % or greater), a Dy metal (having a purity of 99 wt % or greater), a Co metal (having a purity of 99 wt % or greater), ferroboron (Fe 80 wt %, B 20 wt %), a lump of iron (having a purity of 99 wt % or greater), a Ga metal (having a purity of 99 wt % or greater), an Al metal (having a purity of 99 wt % or greater), a Cu metal (having a purity of 99 wt %), and a Zr metal (having a purity of 99 wt % or greater) were weighed to provide compositions of alloys 1 to 8 shown in Table 1 and were put into an alumina crucible. "TRE" shown in Table 1 represents a total of rare earth elements. In addition, the composition "bal." of Fe means the balance. C, O, and N shown in Table 1 are inevitable impurities contained in the raw materials.

Thereafter, the alumina crucible was put into a high frequency vacuum induction furnace. The atmosphere in the furnace was replaced by Ar and melting the raw materials was performed by heating to 1450° C. to obtain a molten alloy. Next, the obtained molten alloy was supplied to a water cooling roll made from a copper alloy using a tundish and was then solidified (strip cast (SC) method) to provide a cast alloy, and it was separated from the cooling roll.

Thereafter, the cast alloy was pulverized into a diameter of approximately 5 mm, and thus cast alloy flakes having compositions of each alloy 1 to 8, respectively, were obtained.

A backscattered electron image of the cast alloy flake of the alloy 2 is shown in FIG. 1. As for the backscattered electron image shown in FIG. 1, the cast alloy flake was embedded in a resin and a cross-section subjected to mirror polishing was observed through the backscattered electron image at 500-fold magnification.

Approximately 90% of the cast alloy flakes of the alloys 1 to 8 obtained in the above-described order was grouped as a first alloy, while the remaining approximately 10% was grouped as a second alloy. Next, the first alloy was cracked using the following hydrogen decrepitation method. First, hydrogen was absorbed at room temperature in the cast alloy flakes under a hydrogen atmosphere of 1 atm. Next, the cast alloy flakes absorbing the hydrogen were heat-treated to 300° C. by heating in the hydrogen. Thereafter, a heat treatment was performed so that the temperature was increased from 300° C. to 500° C. under reduced pressure and held for 1 hour at 500° C., to release and remove the hydrogen in the cast alloy flakes. Next, Ar was supplied to the inside of the furnace to perform cooling to the room temperature.

Next, the hydrogen-cracked cast alloy flakes were pulverized using high-pressure nitrogen of 0.6 MPa with a jet mill (100AFG, Hosokawa Micron Group) to obtain R-T-B alloy powders of the alloys 1 to 8.

0.02 mass % to 0.03 mass % of zinc stearate as a lubricant was added to the powders of the first alloy obtained as described above, and the resulting materials were subjected to press molding using a molding machine in a transverse magnetic field at a molding pressure of 0.8 t/cm$^2$ while a magnetic field of 1.0 T was applied thereto. Accordingly, compacts of Test Examples 1 to 12 and 51 to 54 shown in Table 3 were formed (molding process). The compact has a cubic shape having one side of 10 mm.

Thereafter, regarding the compacts of Test Examples 1 to 12, the compact was disposed and sintered together with an alloy material (cast alloy flakes of the second alloy) shown in Table 3 in a chamber of a sintering furnace to form a sintered body (sintering process). The sintering process was performed in a manner such that the alloy material was disposed to be spread over the entire surface in a tray made of carbon when viewed from the top, and then the compact was installed on the alloy material and the tray was disposed in the chamber of the sintering furnace.

In addition, regarding the compacts of Test Examples 51 to 54, only the compact on a tray made of carbon was disposed and sintered in the chamber of the sintering furnace to form a sintered body.

The sintering of Test Examples 1 to 12 and 51 to 54 are performed at a temperature of 1010° C. for 180 minutes in vacuum.

After the sintering, the alloy material was removed from the chamber. Thereafter, each of the sintered bodies was heat-treated so that it was heat-treated at 800° C. for 1 hour in a first stage, and then heat-treated at 500° C. for 1 hour in a second stage in an argon atmosphere, and thus R-T-B magnets of Test Examples 1 to 12 and 51 to 54 were prepared.

Each of the obtained R-T-B magnets of Test Examples 1 to 12 and 51 to 54 was subjected to mirror polishing in a manner such that the magnet was embedded in an epoxy resin, and a surface parallel to an axis of easy magnetization (C axis) was shaved off. This surface subjected to the mirror polishing was observed through a backscattered electron image at 1500-fold magnification, and a main phase, an R-rich phase, and a transition metal-rich phase were distinguished by the contrast thereof.

As a result, it was found that in Test Examples 1 to 12, a white R-rich phase and a light gray transition metal-rich phase were present in a grain boundary between black main phase grains.

Figure 2:
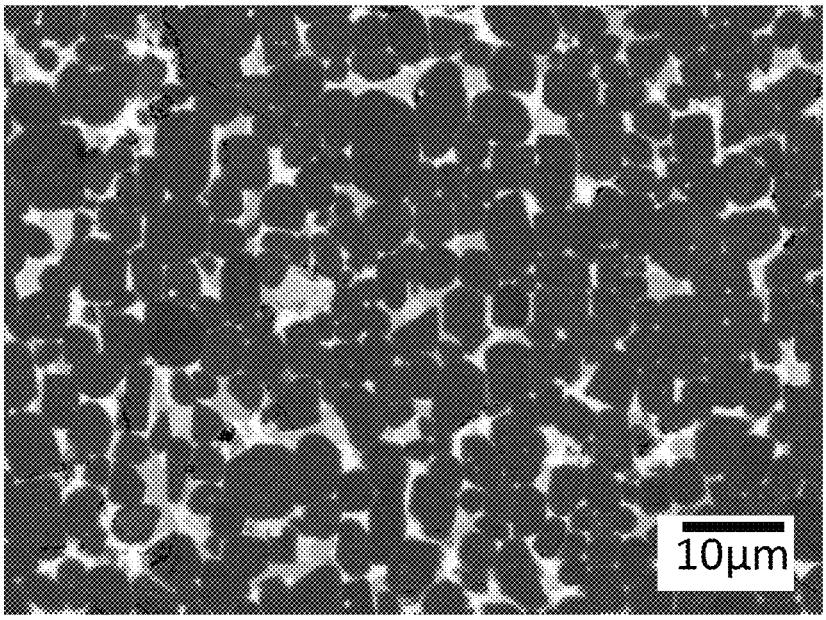
FIG. 2 is a microphotograph of an R-T-B magnet of Test Example 3.
Figure 3:
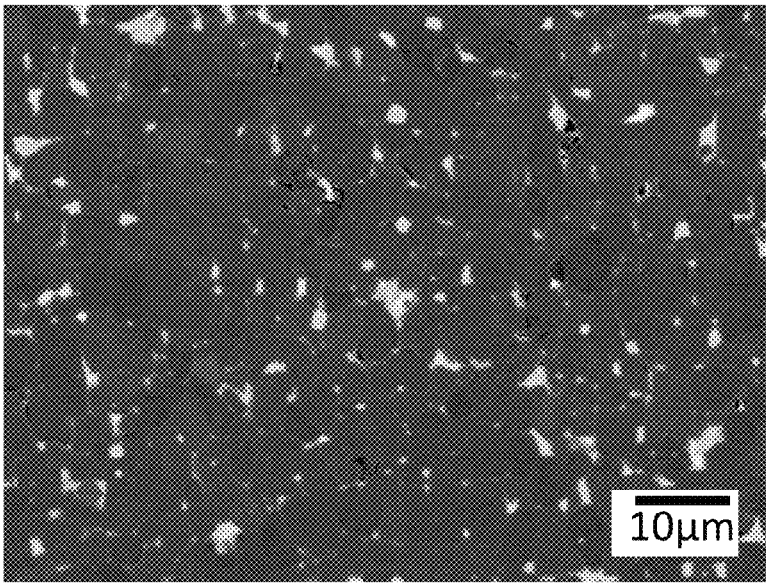
FIG. 3 is a microphotograph of an R-T-B magnet of Test Example 51.

FIG. 2 is a microphotograph obtained by observing the R-T-B magnet of Test Example 3 through a backscattered electron image, and FIG. 3 is a microphotograph obtained by observing the R-T-B magnet of Test Example 51 through a backscattered electron image. The direction of the axis of easy magnetization (C axis) of the R-T-B magnets shown in FIGS. 2 and 3 corresponds to a horizontal direction in FIGS. 2 and 3.

As shown in FIG. 2, in the R-T-B magnet of Test Example 3, main phase grains were isolated by a grain boundary phase surrounding the main phase grains.

However, in the R-T-B magnet of Test Example 51 shown in FIG. 3, the contours of main phase grains were not clear and a plurality of main phase grains were in contact with each other, compared to the R-T-B magnet of Test Example 3.

In addition, the compositions of the R-T-B magnets of Test Examples 1 to 12 and 51 to 54 were measured using an inductively coupled plasma (ICP) apparatus. The results thereof are shown in Table 2.

As shown in Tables 1 to 3, in the R-T-B magnet of Test Example 1 in which the alloy 1 was used in both of the compact and the alloy material, TRE is greater than the R-T-B magnet of Test Example 51 in which the compact made from the alloy 1 without using an alloy material was sintered.

In addition, in the R-T-B magnet of Test Example 8 in which the alloy 2 was used in both of the compact and the alloy material, TRE is greater than the R-T-B magnet of Test Example 52 in which the compact made from the alloy 2 without using an alloy material was sintered.

In addition, in the R-T-B magnet of Test Example 12 in which the alloy 7 was used in both of the compact and the alloy material, TRE is greater than the R-T-B magnet of Test Example 54 in which the compact made from the alloy 7 without using an alloy material was sintered.

From the results, it is found that when the compact is sintered with the alloy material disposed in the chamber of the sintering furnace, the grain boundary phase component is supplied from the alloy material to the compact.

In addition, in Test Example 3 in which the alloy 3 was used as the alloy material, TRE is greater than in Test Examples 4 and 5 in which an alloy with greater TRE than the alloy 3 was used as the alloy material. The alloy 3 contains Cu, and the alloy (alloy 4 or 5) used as the alloy material in Test Examples 4 and 5 contains no Cu. Thus, it is found that when the alloy material contains Cu, the grain boundary phase component can be efficiently supplied from the alloy material to the compact.

In addition, magnetic properties of each of the R-T-B magnets of Test Examples 1 to 12 and 51 to 54 were measured using a BH curve tracer (TPM2-10, Toei Industry Co., Ltd.). The results thereof are shown in Table 3 and FIGS. 4 to 6. In Table 3 and FIGS. 4 to 6, "Hcj" is coercivity and "Br" is remanence.

TABLE 1

| | TRE | Nd | Pr | Dy | Fe | Co | B | Ga | Al | Cu | Zr | C | O | at % N |
|---|---|---|---|---|---|---|---|---|---|---|---|---|---|---|
| ALLOY 1 | 14.5 | 12.1 | 2.3 | 0.0 | bal. | 0.0 | 6.0 | 0.00 | 0.5 | 0.10 | 0.00 | 0.08 | 0.05 | 0.04 |
| ALLOY 2 | 14.8 | 11.0 | 3.8 | 0.0 | bal. | 0.6 | 5.3 | 0.54 | 0.5 | 0.05 | 0.14 | 0.05 | 0.05 | 0.01 |
| ALLOY 3 | 16.5 | 12.3 | 4.2 | 0.0 | bal. | 0.6 | 5.2 | 0.95 | 0.6 | 0.14 | 0.00 | 0.07 | 0.06 | 0.01 |
| ALLOY 4 | 17.8 | 13.3 | 4.5 | 0.0 | bal. | 0.0 | 5.3 | 0.0 | 0.2 | 0.00 | 0.00 | 0.09 | 0.07 | 0.00 |
| ALLOY 5 | 19.7 | 14.8 | 4.9 | 0.0 | bal. | 0.0 | 5.4 | 0.0 | 0.2 | 0.00 | 0.00 | 0.01 | 0.13 | 0.01 |
| ALLOY 6 | 13.5 | 7.6 | 2.2 | 3.8 | bal. | 2.2 | 5.6 | 0.07 | 0.4 | 0.10 | 0.00 | 0.07 | 0.06 | 0.01 |
| ALLOY 7 | 15.5 | 8.7 | 2.9 | 3.8 | bal. | 0.6 | 5.0 | 0.55 | 0.5 | 0.11 | 0.00 | 0.07 | 0.06 | 0.01 |
| ALLOY 8 | 16.1 | 12.0 | 4.1 | 0.0 | bal. | 0.6 | 5.1 | 0.59 | 0.5 | 0.13 | 0.00 | 0.05 | 0.05 | 0.01 |

TABLE 2

| | TRE | Nd | Pr | Dy | Fe | Co | B | Ga | Al | Cu | Zr | C | O | at % N |
|---|---|---|---|---|---|---|---|---|---|---|---|---|---|---|
| TEST EXAMPLE 1 | 15.5 | 12.9 | 2.6 | 0.0 | bal. | 0.00 | 5.43 | 0.00 | 0.70 | 0.16 | 0.00 | 0.28 | 0.62 | 0.19 |
| TEST EXAMPLE 2 | 15.3 | 13.0 | 2.3 | 0.0 | bal. | 0.12 | 5.60 | 0.12 | 0.70 | 0.10 | 0.00 | 0.22 | 0.61 | 0.19 |
| TEST EXAMPLE 3 | 18.7 | 15.0 | 3.7 | 0.0 | bal. | 0.14 | 5.11 | 0.49 | 0.71 | 0.23 | 0.00 | 0.29 | 0.65 | 0.20 |
| TEST EXAMPLE 4 | 17.5 | 13.9 | 3.6 | 0.0 | bal. | 0.00 | 5.54 | 0.00 | 0.44 | 0.08 | 0.00 | 0.23 | 0.64 | 0.19 |
| TEST EXAMPLE 5 | 17.9 | 14.2 | 3.7 | 0.0 | bal. | 0.00 | 5.53 | 0.00 | 0.44 | 0.08 | 0.00 | 0.23 | 0.64 | 0.20 |
| TEST EXAMPLE 6 | 14.0 | 11.7 | 2.3 | 0.0 | bal. | 0.00 | 5.75 | 0.00 | 0.53 | 0.10 | 0.00 | 0.22 | 0.61 | 0.19 |
| TEST EXAMPLE 7 | 15.1 | 11.4 | 3.7 | 0.0 | bal. | 0.50 | 4.90 | 0.55 | 0.70 | 0.10 | 0.13 | 0.28 | 0.62 | 0.19 |
| TEST EXAMPLE 8 | 15.3 | 11.5 | 3.9 | 0.0 | bal. | 0.52 | 4.88 | 0.71 | 0.68 | 0.08 | 0.13 | 0.28 | 0.62 | 0.19 |
| TEST EXAMPLE 9 | 17.4 | 12.8 | 4.6 | 0.0 | bal. | 0.51 | 4.81 | 0.52 | 0.69 | 0.09 | 0.13 | 0.28 | 0.64 | 0.20 |
| TEST EXAMPLE 10 | 17.6 | 12.9 | 4.7 | 0.0 | bal. | 0.62 | 4.85 | 0.52 | 0.48 | 0.11 | 0.13 | 0.23 | 0.64 | 0.20 |
| TEST EXAMPLE 11 | 19.2 | 14.0 | 5.1 | 0.0 | bal. | 0.58 | 5.46 | 0.49 | 0.46 | 0.10 | 0.13 | 0.23 | 0.65 | 0.20 |
| TEST EXAMPLE 12 | 16.0 | 9.4 | 3.0 | 3.8 | bal. | 0.53 | 4.80 | 0.72 | 0.69 | 0.14 | 0.00 | 0.30 | 0.63 | 0.19 |
| TEST EXAMPLE 51 | 14.4 | 12.1 | 2.3 | 0.0 | bal. | 0.00 | 5.51 | 0.00 | 0.70 | 0.13 | 0.00 | 0.27 | 0.61 | 0.19 |
| TEST EXAMPLE 52 | 14.8 | 11.1 | 3.7 | 0.0 | bal. | 0.51 | 4.96 | 0.55 | 0.69 | 0.09 | 0.13 | 0.28 | 0.62 | 0.19 |
| TEST EXAMPLE 53 | 15.0 | 11.2 | 3.8 | 0.0 | bal. | 0.56 | 4.98 | 0.55 | 0.48 | 0.10 | 0.00 | 0.28 | 0.62 | 0.19 |
| TEST EXAMPLE 54 | 15.5 | 8.7 | 2.9 | 3.8 | bal. | 0.57 | 5.05 | 0.55 | 0.48 | 0.11 | 0.00 | 0.27 | 0.61 | 0.19 |

TABLE 3

| | COMPACT | ALLOY MATERIAL | Br (kG) | Hcj (k0e) |
|---|---|---|---|---|
| TEST EXAMPLE 1 | ALLOY 1 | ALLOY 1 | 13.85 | 15.32 |
| | | | 13.72 | 14.99 |
| | | | 13.67 | 14.71 |
| | | | 13.67 | 15.14 |
| | | | 13.55 | 15.12 |
| TEST EXAMPLE 2 | ALLOY 1 | ALLOY 2 | 13.68 | 15.86 |
| | | | 13.71 | 15.86 |
| | | | 13.66 | 16.31 |
| TEST EXAMPLE 3 | ALLOY 1 | ALLOY 3 | 12.32 | 19.00 |
| | | | 12.78 | 18.35 |
| | | | 12.36 | 19.10 |
| TEST EXAMPLE 4 | ALLOY 1 | ALLOY 4 | 13.50 | 14.79 |
| | | | 13.53 | 14.69 |
| | | | 13.51 | 14.69 |
| TEST EXAMPLE 5 | ALLOY 1 | ALLOY 5 | 12.97 | 16.33 |
| | | | 12.94 | 16.71 |
| TEST EXAMPLE 6 | ALLOY 1 | ALLOY 6 | 14.05 | 15.11 |
| | | | 13.98 | 15.24 |
| | | | 14.03 | 15.36 |
| TEST EXAMPLE 7 | ALLOY 2 | ALLOY 1 | 13.29 | 19.24 |
| TEST EXAMPLE 8 | ALLOY 2 | ALLOY 2 | 13.09 | 19.23 |
| | | | 13.25 | 19.12 |
| | | | 13.15 | 19.25 |
| TEST EXAMPLE 9 | ALLOY 2 | ALLOY 3 | 12.34 | 21.77 |
| | | | 12.22 | 21.78 |
| | | | 11.93 | 22.37 |
| | | | 12.41 | 21.83 |
| TEST EXAMPLE 10 | ALLOY 2 | ALLOY 4 | 11.99 | 23.21 |
| | | | 12.39 | 21.81 |
| TEST EXAMPLE 11 | ALLOY 2 | ALLOY 5 | 11.76 | 21.66 |
| TEST EXAMPLE 12 | ALLOY 7 | ALLOY 7 | 10.39 | 44.93 |
| | | | 10.18 | 44.52 |
| TEST EXAMPLE 51 | ALLOY 1 | NONE | 14.30 | 14.37 |
| | | | 14.38 | 14.22 |
| | | | 14.31 | 14.28 |
| | | | 14.35 | 14.31 |
| | | | 14.36 | 14.32 |
| TEST EXAMPLE 52 | ALLOY 2 | NONE | 13.35 | 18.26 |
| | | | 13.37 | 18.31 |
| | | | 13.49 | 17.20 |
| | | | 13.37 | 17.78 |
| TEST EXAMPLE 53 | ALLOY 8 | NONE | 13.02 | 20.53 |
| | | | 12.97 | 20.28 |
| | | | 13.00 | 20.49 |
| | | | 13.00 | 20.55 |
| | | | 13.08 | 20.06 |
| TEST EXAMPLE 54 | ALLOY 7 | NONE | 10.72 | 41.45 |
| | | | 10.79 | 41.39 |

Figure 4:
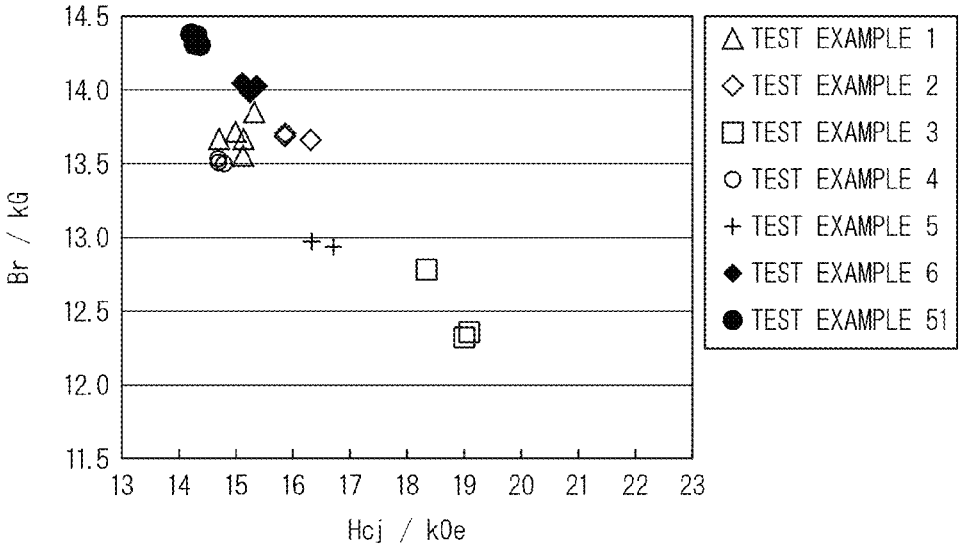
FIG. 4 is a graph showing the relationship between coercivity "Hcj" and remanence "Br".

In Table 3 and FIG. 4, the R-T-B magnets of Test Examples 1 to 6 had high coercivity and low remanence, compared to the R-T-B magnet of Test Example 51.

Figure 5:
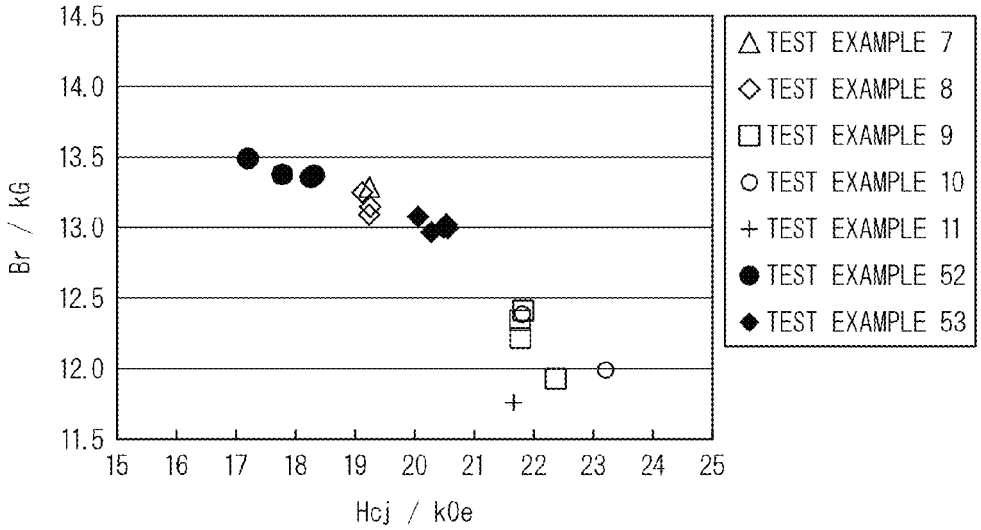
FIG. 5 is a graph showing the relationship between coercivity "Hcj" and remanence "Br".

In Table 3 and FIG. 5, the R-T-B magnets of Test Examples 7 to 11 had high coercivity and low remanence, compared to the R-T-B magnet of Test Example 52.

Figure 6:
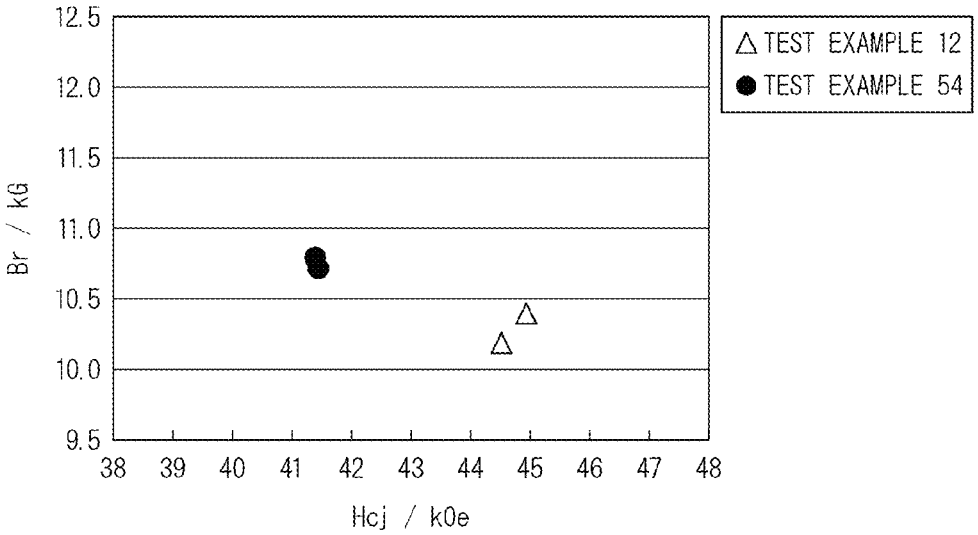
FIG. 6 is a graph showing the relationship between coercivity "Hcj" and remanence "Br".

In Table 3 and FIG. 6, the R-T-B magnet of Test Example 12 had high coercivity and low remanence, compared to the R-T-B magnet of Test Example 54.

A result in which when the compact and the alloy material were disposed and sintered in the chamber of the sintering furnace, it was possible to improve the coercivity of the R-T-B magnet was obtained.

Figure 7:
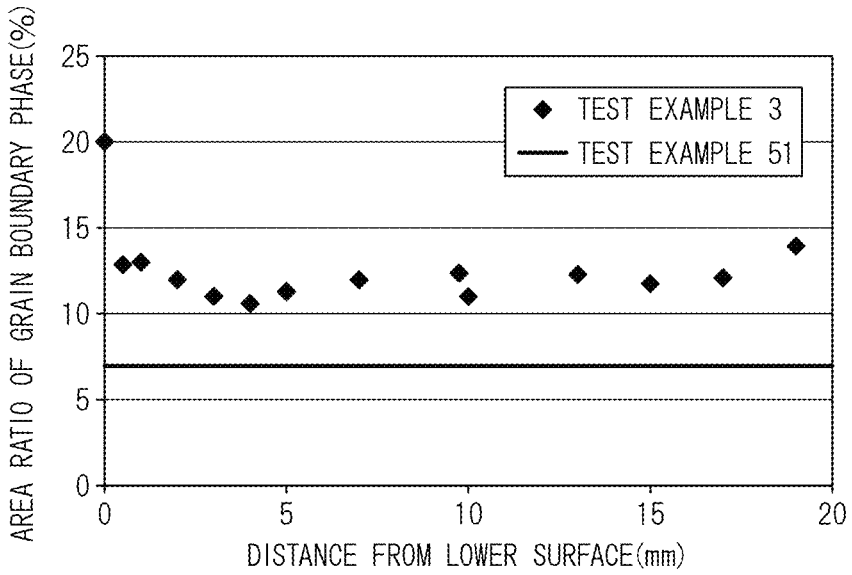
FIG. 7 is a graph showing the relationship between a distance from a lower surface of each of the R-T-B magnets of Test Examples 3 and 51 and a grain boundary phase area ratio.
Figure 8:
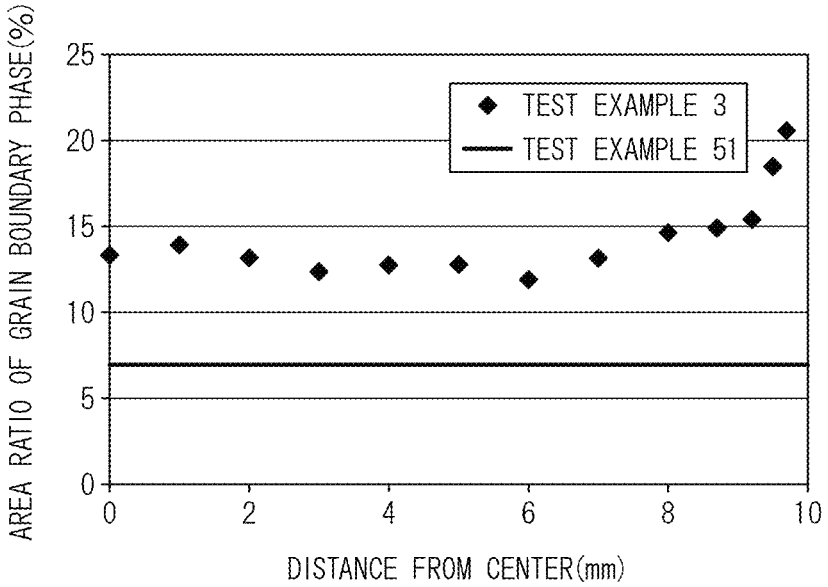
FIG. 8 is a graph showing the relationship between a distance from the center to a side surface of each of the R-T-B magnets of Test Examples 3 and 51 and a grain boundary phase area ratio.

In addition, using the following method, the amount of change in the ratio (grain boundary phase area ratio) of the area of the grain boundary phase per unit area in a depth direction of the R-T-B magnet of Test Example 3 was checked. The results thereof are shown in FIGS. 7 and 8. The magnet used in this measurement has a cubic shape having one side of 20 mm.

The measurement of the grain boundary phase area ratio was performed as follows. Each R-T-B magnet was subjected to mirror polishing in a manner such that the magnet was embedded in an epoxy resin, and a surface parallel to an axis of easy magnetization (C axis) was shaved off. This surface subjected to the mirror polishing was observed through a backscattered electron image at 1500-fold magnification, and a main phase, an R-rich phase, and a transition metal-rich phase were distinguished by the contrast thereof. Then, using image analysis software, the areas of the R-rich phase and the transition metal-rich phase were measured and the sum of the areas was divided by the area of the observation field to calculate the grain boundary phase area ratio.

FIG. 7 is a graph showing the relationship between a distance from a bottom of the R-T-B magnet of Test Example 3 and a grain boundary phase area ratio. FIG. 8 is a graph showing the relationship between a distance from the center to a side surface of the R-T-B magnet of Test Example 3 and a grain boundary phase area ratio. FIGS. 7 and 8 show the grain boundary phase area ratio of Test Example 51 for comparison.

As shown in FIGS. 7 and 8, in the R-T-B magnet of Test Example 3, the amount of change in the grain boundary phase area ratio between an area which was positioned inside by a distance of 0.5 mm from an outer surface (upper and lower surfaces, opposed side surfaces) and an area which was positioned inside by a distance of 10 mm from the foregoing outer surface was 4% or less.

As shown in FIGS. 7 and 8, in the R-T-B magnet of Test Example 3, since the grain boundary phase component was diffused from the alloy material (second alloy) to the compact by performing the sintering process, the ratio of the grain boundary phase was entirely higher than in Test Example 51.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A method of manufacturing an R-T-B rare earth sintered magnet, comprising:

a molding step of forming a compact of a first alloy powder;

a sintering step of disposing and sintering the compact and an alloy material of a second alloy which are in contact with each other, in a chamber of a sintering furnace to turn the compact into a sintered body, wherein the alloy material is disposed to cover an entire upper surface of the compact and a removal step of removing the alloy material from the sintered body after the sintering step, wherein the first alloy comprises R which represents a rare earth element, T which represents a transition metal essentially containing Fe and Cu, B, and inevitable impurities;

wherein the first alloy contains 11 at % to 17 at % of R, 4.5 at % to 6 at % of B, and T as the balance, wherein the second alloy comprises R which represents a rare earth element, T which represents a transition metal essentially containing Fe, B, and inevitable impurities;

wherein the second alloy contains 11 at % to 20 at % of R, 4.5 at % to 6 at % of B, and T as the balance; and wherein the alloy material comprises cast alloy flakes of the second alloy.

2. The method of manufacturing an R-T-B rare earth sintered magnet according to claim 1, wherein the first alloy contains 0.05 at % to 0.2 at % of Cu.

3. The method of manufacturing an R-T-B rare earth sintered magnet according to claim 1, wherein the first alloy contains 0 at % to 1.6 at % of a metal element M which represents Al and/or Ga.

4. The method of manufacturing an R-T-B rare earth sintered magnet according to claim 1, wherein Dy content in all of the rare earth elements of the first alloy is 0 at % to 29 at %.

5. The method of manufacturing an R-T-B rare earth sintered magnet according to claim 4, wherein the first alloy contains 13.5 at % to 17 at % of R without containing Dy.

6. The method of manufacturing an R-T-B rare earth sintered magnet according to claim 1, wherein the second alloy contains 0.05 at % to 0.2 at % of Cu.

7. The method of manufacturing an R-T-B rare earth sintered magnet according to claim 1, wherein the second alloy contains 0 at % to 1.6 at % of a metal element M which represents Al and/or Ga.

8. The method of manufacturing an R-T-B rare earth sintered magnet according to claim 1, wherein Dy content in all of the rare earth elements of the second alloy is 0 at % to 29 at %.

9. The method of manufacturing an R-T-B rare earth sintered magnet according to claim 8, wherein the second alloy contains 13.5 at % to 17 at % of R without containing Dy.

10. The method of manufacturing an R-T-B rare earth sintered magnet according to claim 1, wherein the second alloy is formed of a main phase composed of $R_2T_{14}B$ and a grain boundary phase including a larger amount of R than the main phase, and the ratio of the grain boundary phase contained in the second alloy is 6 mass % or greater and less than 15 mass %.

11. The method of manufacturing an R-T-B rare earth sintered magnet according to claim 1, wherein in the sintering step, the sintering is performed for 30 minutes to 180 minutes at 800° C. to 1150° C.

* * * * *